United States Patent [19]

Bürkle et al.

[11] 3,952,139

[45] Apr. 20, 1976

[54] CIRCUIT ARRANGEMENT FOR SUPPLYING ELECTRODE MELTING FURNACES

[75] Inventors: Peter Bürkle; Wolfgang Timpe, both of Erlangen; Friedrich Werner Thomas, Niedermittlau, all of Germany

[73] Assignee: Siemens Aktiengesellschaft, Munich, Germany

[22] Filed: Dec. 20, 1974

[21] Appl. No.: 534,831

[52] U.S. Cl. ..... 13/13

[51] Int. Cl.[2] ..... H05B 7/148

[58] Field of Search ..... 13/9, 9 ES, 12, 13; 321/5, 5 A; 323/4, 22 SC; 219/131 WR

[56] References Cited

UNITED STATES PATENTS

| | | | |
|---|---|---|---|
| 3,530,359 | 9/1970 | Grist | 321/5 A |
| 3,660,583 | 5/1972 | Takanasi | 13/12 |
| 3,746,965 | 7/1973 | Okada | 321/5 |
| 3,803,476 | 4/1974 | Reeve | 321/5 |

FOREIGN PATENTS OR APPLICATIONS

| | | | |
|---|---|---|---|
| 2,029,177 | 10/1970 | France | 13/12 |

*Primary Examiner*—R. N. Envall, Jr.
*Attorney, Agent, or Firm*—Kenyon & Kenyon Reilly Carr & Chapin

[57] ABSTRACT

The invention concerns a converter arrangement for electrode melting furnaces, particularly for electric slag remelting of metals. A current regulator in the form of a PI controller is associated with the converter arrangement. The former is influenced by an actual current value, a reference current value, and additionally, by a control quantity. The control quantity replaces the current regulation of the regulator by a voltage control in dependence on periodic or aperiodic conditions which may be due to operational causes or to trouble and interfere with the melting process in the furnace. More particularly, for the duration of such conditions, the control quantity causes the output voltage of the regulator, which voltage acts on the control unit feeding the converter, to be limited upward to an adjustable value.

15 Claims, 5 Drawing Figures

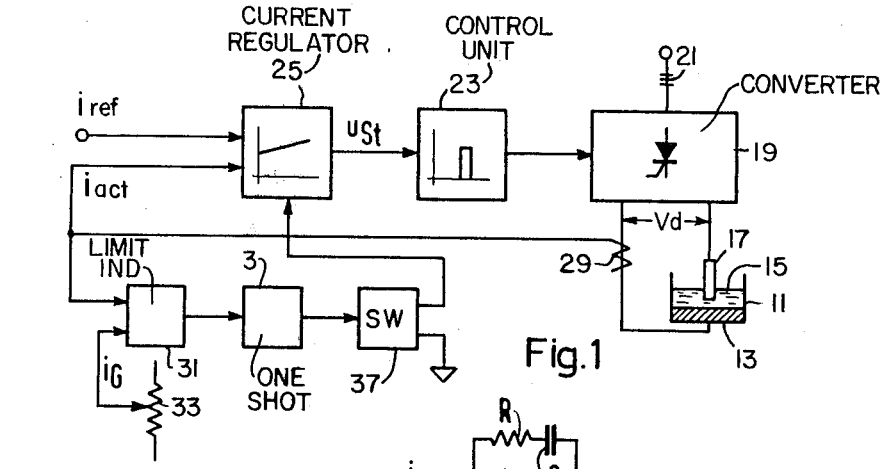
Fig.1
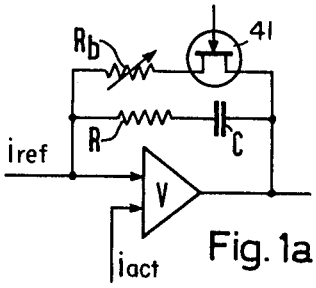
Fig. 1a
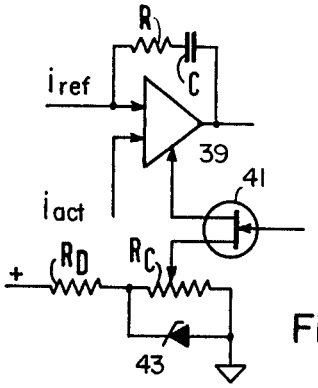
Fig.1b
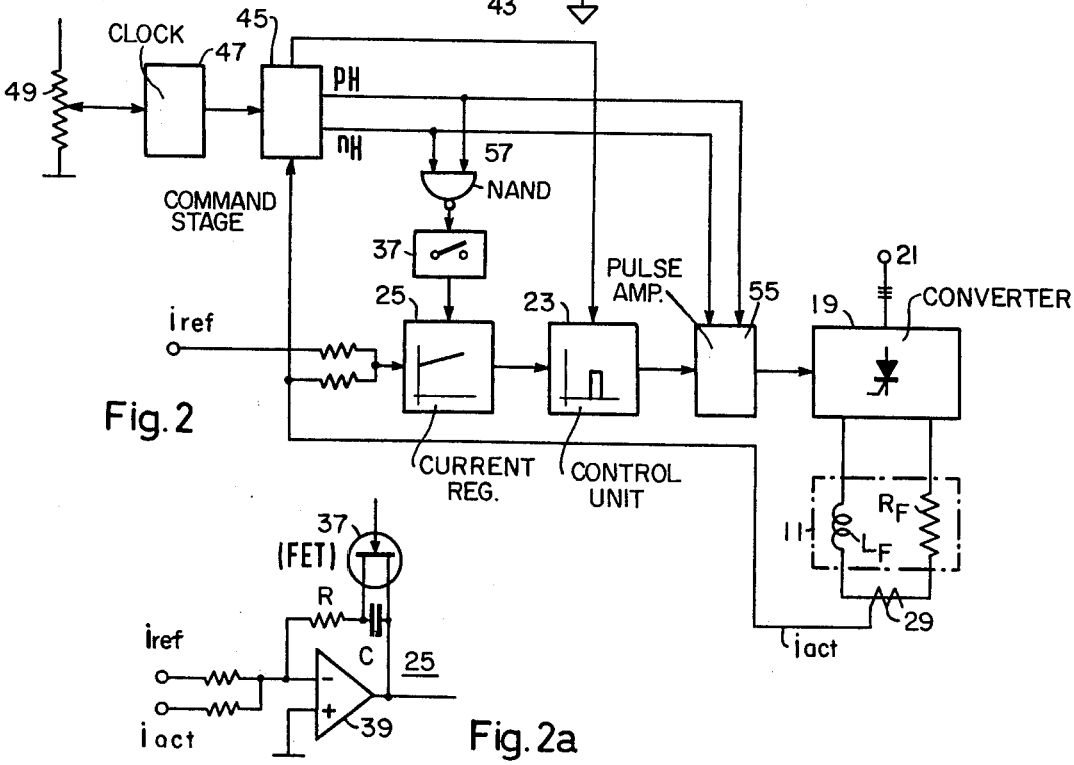
Fig. 2
Fig. 2a

CIRCUIT ARRANGEMENT FOR SUPPLYING ELECTRODE MELTING FURNACES

BACKGROUND OF THE INVENTION

1. Field of the Invention

The invention concerns a circuit arrangement for supplying electrode melting furnaces and, in particular, melting furnaces for electric slag remelting of metals, from a single or multi-phase network of the local supply system.

2. Description of the Prior Art

Melting furnaces of this kind for metal refining and measures to supply them are known from the German Auslegeschrift 1,917,494. The latter reference suggests that optimal metallurgical properties for a melting furnace can be realized by feeding the furnace with a frequency substantially lower than the line frequency of between about 5 and 10 Hz by means of a controlled converter arrangement having a variable frequency and conduction time.

The present invention involves a converter arrangement, provided between a supply network and a furnace installation, in which the conduction times and the waveform of the positive and negative half-waves of the supply current for the furnace, drawn from the converter, are optimally adapted to the metallurgical requirements, and in which the intervals between the aforesaid two half-waves are adapted to the properties (recovery protection times) of the thyristor groups associated with the converter. In particular, the invention is concerned with a problem frequently occurring with electrode melting-furnace supplies employing such a converter arrangement, namely, the problem of preventing the valuable thyristors of the converter and the electrical parts of the furnace from being overloaded as a result of the so called "running-up" of the output voltage of the current regular associated with the converter. Since such a current regulator is designed to increase its output voltage up to a maximum when the current value of the furnace is less than a predetermined current reference value i.e., to exhibit so called "PI behavior", "running-up" of the output voltage typically occurs during a lifting of an electrode from the melt or during one of the aforementioned currentless intervals provided for the recovery protection of the thyristors.

Ideally, the current waveform derived from the converter arrangement of an electrode melting furnace supply system should have a frequency that can be adjusted continuously, i.e., without jumps, within a frequency range of about 3 to 10 Hz and should have approximately a rectangular shape for each half-wave. Moreover because of the protection recovery time of the thyristors, the waveform should have a currentless interval between these half-waves which should be at least equal to, but preferably longer than, such protection time. As a result of the finite lead inductances of the furnace terminals, on the one hand, and of the aforementioned PI behavior of the current regulator of the supply system, on the other hand, the actual current waveform produced by the converter deviates from the desired rectangular shape, with a nonlinear rise and decay occurring in each half-wave. While efforts to increase the initial slope of the waveform after each zero interval have presented difficulties, since "overshoot" beyond the desired current value must be prevented in each half-wave at all costs, making the trailing edge of the half-wave current waveform steeper is desirable and is possible through the action of the appropriately designed command stage which is clock-controlled and acts on the control unit feeding the converter.

SUMMARY OF THE INVENTION

Accordingly, the present invention is a circuit arrangement for electrode melting furnaces, particularly for the electric slag remelting of metals, which are supplied from the power network by means of a converter arrangement having an associated control unit preceded by a current regulator which is influenced by a current reference value and an actual current value. In particular, the circuit arrangement of the present invention causes the current regulator, designed as a PI controller, to be additionally influenced by a control quantity which, in dependence on periodic or aperiodic conditions which are due to operational causes or to trouble and interfere with the melting process in the furnace, replaces for their duration the current regulation by a voltage control which limits the voltage acting on the control unit of the converter upward to an adjustable value.

The particular regulating control and protective measures are therefore obtained essentially by action on the current regulator and can be applied, as required, individually or jointly.

BRIEF DESCRIPTION OF THE DRAWING

The above and other features and aspects of the present invention will be made clearer by making reference to the following detailed description, viewed in conjunction with the accompanying drawing, in which:

FIG. 1 illustrates a circuit arrangement in accordance with the present invention which is being used to supply an electrode melting furnace;

FIGS. 1(*a*) and 1(*b*) show particular electrical circuit configurations for portions of the circuit arrangement of FIG. 1;

FIG. 1 illustrates an electrode melting furnace 11 including a crucible 13 containing a slag charge 15 in which is disposed an immersion electrode 17. The electrode 17 and crucible 13 are coupled across the output of a converter 19 supplied on its primary size by a three phase network 21. The converter 19 is controlled in conventional fashion by means of a control unit 23 which provides firing pulses to the converter devices. The control unit obtains an input from a current regulator 25 which is designed as a proportional intergral [PI] controller. Specifically, the control unit 23 causes the converter 19 to deliver to the furnace an A-C current having a frequency controllable between 0 and 10 Hz, for example. This supply current has special half wave hape which has a curved rising portion, and approximately horizontal middle portion and a curved decaying portion. Between these alternatingly positive and negative half-waves there is an interval without current flow, which interval is made at least equal to, but preferably longer than, the recovery time of the thyristors (not shown) comprising the converter 19. To the inputs of the current regulator 25 are fed a variable current reference value $i_{ref}$, the latter being derived from a conventional current source (not shown), and an actual current value $i_{act}$, the latter being taken from the current transformer 29 associated with the furnace supply circuit. A clock-controlled command stage (not shown in this figure) acts in a conventional manner on the current regulator 25 and the control unit 23 to determine the half-wave sequence, waveshape and frequency of the alternating furnace supply current being delivered at the output of the converter 19. The r.m.s. value of this alternating current, in turn, is determined by the current regulator in accordance with the pre-settable current reference value $i_{ref}$ in comparison with the actual current value $i_{act}$.

Since the current regulator 25 is an amplifier bridged by an R-C series member (this is shown in FIG. 1(*a*)), it has, as above indicated, so called "PI behavior", i.e., its output voltage $V_{St}$, fed to the control unit 23, can increase up to a maximum value if, and as long as, the actual value $i_{act}$ is smaller than the desired value $i_{ref}$. The actual current value is, therefore, made to follow the pre-set, desired current value continuously.

In the operation of an electrode melting furnace, particularly during start-up, but also during the melting process, conditions occur, due to operational causes or to trouble, which briefly interrupt the passage of current between the electrode, the melt and the crucible. For example, such a current interruption occurs when an electrode is lifted from the melt. In any event, for the duration of the interruption the actual current value $i_{act}$ is no longer present at the input of the current regulator IR, and the control loop is no longer closed. Due to the PI behavior of the regulator, the aforesaid absence of current causes the control voltage $V_{St}$ at the output thereof to increase to its maximum value. Such increase, in turn, causes the output voltage $V_d$ at the converter output to likewise increase to its maximum value. Under such circumstances, if the cause of the current interruption is removed (e.g., the electrode 17 is again immersed in the melt 15), intolerable overcurrents will result which can endanger the electrical part of the furnace installation 11 and also the material to be melted.

Similarly, such overcurrents may also occur during the start-up of the furnace. More particularly, it is possible that a high electrode voltage at start-up might only result in a relatively small current flow, due to a large transition resistance that may be present. However, in the event of a sudden "breakthrough", instantaneous currents would result that are much too high and, as a result, endanger the furnace and melt.

Thus, in order to avoid the aforesaid overcurrent conditions, the present invention provides for a supplemental quantity to be fed into the current regulator to replace the current regulation by voltage control. The "running-up" of the output voltage $V_{St}$ of the regulator 25 is thereby prevented, such voltage now being kept at a value which causes a furnace current of only, say, 1/10 to ½ of the nominal current flow. To carry out the aforesaid protective measure, a limit indicator 31, as shown in FIG. 1, is provided which monitors the actual current value and delivers an output signal each time such actual current exceeds, or falls below, a limit value $i_G$ which can be set by the potentiometer 33. The indicator output signal is then applied to the regulator IR, via one shot multivibrator 35 and an electronic switch 37, such that it acts to influence the regulator in the sense of limiting the output voltage thereof.

More specifically, as soon as the actual current value $i_{act}$ falls below the value $i_G$, which value, as above-mentioned, can be set at the limit indicator 31 by 33, the limit indicator 31, as well as a one shot multivibrator 35 that follows it, respond. At the end of a waiting period adjustable at the latter, the one shot multivibrator 35 acts upon the switch 37 which, in turn, acts upon the regulator 25 to limit the maximum value of the regulator output control voltage $V_{st}$ upward. This limiting action is cancelled as soon as the actual value $i_{act}$ again exceeds the set limit $i_G$. When the latter occurs, the limit indicator switches back, thereby causing the switch 37 to open. Thus, the current regulation becomes effective again in place of the voltage control of the regulator 35. The time-delay stage provided between the limit indicator 31 and the switch 37 prevents continuous switching back and forth if the actual value falls below the threshold for a very short time.

The action of the switch 37 upon the regulator 35 can be effected in a variety of ways, two of which are shown in FIGS. 1(*a*) and 1(*b*). More particularly, in FIG. 1(*a*) the feedback capacitor C, which in combination with the resistor R and amplifier 39 form the regulator 35, is discharged with a time constant given by the resistor $R_b$ through the action of a switching transistor 41 which is included in the switch 37 and is driven into saturation. In FIG. 1(*b*), on the other hand, a bias is provided with the resistor $R_C$, the latter resistor being in series with a resistor $R_D$ and bridged by the element 43 e.g. a zener diode, to the limiting input of the regulator amplifier 39 by means of the switching transistor 41 comprising the switch S. A field-effect transistor should preferably be provided for the aforesaid switching transistors 41.

As above-indicated, interruption of the current flowing through the furnace 11 occurs not only when an electrode is lifted from the melt or during start-up, but also when the alternating supply current, derived from the converter 19, goes through zero. This is so because a recovery protection time must be observed during each zero crossing to protect the thyristors included in the converter. Since the protection time required should be at least equal to, but preferably longer than, the thyristor recovery time, the resultant currentless intervals are not negligible as compared to the respective half-wave period. As a result, measures must also be taken during these intervals to prevent a "running-up" of the output voltage of the amplifier of the regulator. Otherwise, beginning with the next half-wave, the electrode voltage and, therefore, the furnace current, would be too high, due to the current regulation, which could result in disadvantages for the charge 15 or could even cause overcurrent protection devices to trip, in which case the charge would have to be considered as lost if the current failure is permanent.

In order to counteract the above, it is desirable to discharge (short circuit) the capacitor C disposed in the amplifier feedback path of the current regulator 25 shortly before, at the start of, and during each currentless interval. As a result, the trailing edge of each current half-wave will decay very steeply toward the zero value. Moreover, "running-up" of the amplifier during the currentless interval is no longer possible, with the result that recharging of the capacitor C at the beginning of the next half-wave takes place starting with a zero-voltage value. At such time, the short circuit of the capacitor is lifted, thereby causing the current regulation to again become effective. The aforesaid switching and control measures can be assumed or initiated by the already existing command stage, as is shown in FIG. 2.

The command stage 45, as is advisable in such installations, is controlled by a clock generator 47, whose clock frequency can be set from 0 to 10 Hz, for instance, by a potential at the frequency selector 49. One output of the command stage 45 influences the control unit 23 of the converter 19 and sets into the latter directly as shown, or, as is also shown, via a pulse amplifier 55, by means of the control lines pH and nH, whether and when the respective thyristor group of the converter 19 is to be addressed for the purpose of forming the positive or negative half-wave, and at which points in time the currentless interval between two respective half-waves is to be fixed, as well as its duration.

As the out-put lines pH (positive half-wave) and *n*H (negative half-wave) must carry control signal voltage only alternatingly and as, furthermore, neither delivers signal voltage during the currentless intervals, the control criterion for switching the current regulator 25 to voltage control is therefore always present if the signal voltage on one of the two lines disappears. This condition is monitored, as illustrated, by a limit indicator and/or NAND gate arrangement 57, which delivers a signal to a switch 37 if, and only if, the output signal disappears on one of the two lines pH or nH. In the meantime it is certain that the other line is free of signal on the basis of the assumptions mentioned above. Through the response of the switch 37, the capacitor C in the feedback path of the amplifier 39 of the current regulator 25 is short-circuited, as may be seen from the auxiliary FIG. 2(*a*). This short circuit is lifted only when, after the end of the currentless interval, control signal appears again at the respective other output line pH, nH of the command stage 45 for the purpose of forming the next half-wave. The switch 37 should also be designed as a field-effect transistor, as also indicated in FIG. 2*a*, as the switching path of this transistor type in the saturated state has particularly low resistance, has no voltage threshold and is independent of the current direction. Also shown on FIG. 2 and FIG. 2*a* are the input summing resistors 51 and 53 to the current regulator amplifier 39.

The other components of FIG. 2 correspond, as far as design and interconnection are concerned, to those of FIG. 1, the melting furnace 11 being symbolized in FIG. 2 only by the inductive load $L_f$ and the ohmic load $R_f$.

What is claimed is:

1. A circuit arrangement for use with an electrode melting furnace and a supply network comprising:

a converter arrangement responsive to said supply network for supplying said furnace;

control means for influencing said converter;

current regulator means for influencing said control means, said regulator being influenced by an actual current value which is indicative of the furnace current and by a reference current value and being of the type whose output voltage increases to a maximum when said actual current is less than said reference current; and means responsive to said actual current falling below a predetermined minimum value for influencing said regulator such that during the duration of said actual current being below said predetermined minimum value the current produced by said regulator is replaced by a voltage control which limits the voltage output of said regulator upward to an adjustable value.

2. A circuit arrangement in accordance with claim 1 in which said means for producing said control quantity includes:

a switch for influencing said regulator;

and a measuring device responsive to said actual current value for triggering said switch when said actual value falls below said minimum value.

3. A circuit arrangement in accordance with claim 2 wherein:

said measuring device includes a limit indicator for comparing said actual value with a limit value and for signalling said switch to transfer the current regulation of said current regulator into a voltage control when said actual value is less than said limit value;

and said means for producing said control quantity further includes a delay device interposed between said measuring device and said switch.

4. A circuit arrangement in accordance with claim 1 in which:

said regulator includes circuit means;

and said means for producing said control quantity includes a switch which provides a means for causing said control quantity to influence said circuit means.

5. A circuit arrangement in accordance with claim 4 in which said switch is a field-effect transistor.

6. A circuit arrangement in accordance with claim 4 in which:

said circuit means includes a feedback path comprising a capacitor;

and said control quantity influences said capacitor.

7. A circuit arrangement in accordance with claim 1 in which:

said conditions are periodic and result in intervals of substantially zero current flow in said furnace;

said regulator includes a feedback path and a capacitor within said path;

and said means for producing said control quantity includes an evaluation device responsive to the lowering of said actual value during said intervals for causing said capacitor to be bridged before, at the start of and during said intervals.

8. A circuit arrangement in accordance with claim 7 in which said evaluation device includes:

a switch for shorting said capacitor;

and a gate arrangement for controlling said switch, said gate being responsive to signals determinative of the direction of the supply provided by said converter to said furnace.

9. A circuit arrangement in accordance with claim 8 in which:

said circuit arrangement further includes:

a clock generator; and a command stage responsive to said clock generator for generating signals determinative of the frequency, waveform, half-wave polarity and duration of intervals between said half-waves of the supply provided by said converter to said furnace, said command stage influencing said control means and providing first and second output signals determinative of said half-wave polarity; and said gate arrangement includes:

a NAND gate whose inputs comprise said first and second output signals.

10. A circuit arrangement in accordance with claim 9 which further includes an amplifier responsive to said command stage interposed between said control means and said converter.

11. A circuit arrangement for controllably supplying an electrode melting furnace from a supply network comprising:

a. a converter having its input coupled to the supply network and its output coupled to said electrode furnance;

b. means for controlling said converter to provide an output at a predetermined frequency and at a predetermined current in response to control inputs;

c. current regulator means having an output coupled as a control input to said control means, said current regulator having as inputs an actual current value which is indicative of the furnace current and a reference current value input, said current regulator being a proportional intergral controller; and d. means repsonsive to said actual value falling below a preestablished minimum value providing an output coupled to said current regulator means for influecing said regulator such that during the presence of said output said regulator output voltage is limited to a predetermined value.

12. Apparatus according to claim 11 wherein said current regulator means comprises an intergrating amplifier having capacitive feedback with a switch placed in parallel with said capacitor, said switch completing a feedback path and having a resistor in series therewith and wherein said switch has a control input for closing said switch coupled to said output from said means responsive to said current falling below said predetermined value.

13. Apparatus according to claim 12 wherein said means responsive comprise a comparator having as a first input said actual current value and as a second input a predetermined minimum value and providing its output when said actual value falls below said predetermined minimum value.

14. Apparatus according to claim 13 and further including delay means between said comparator and said switch.

15. Apparatus according to claim 14 wherein said switch is a field effect transistor.

* * * * *

UNITED STATES PATENT AND TRADEMARK OFFICE

CERTIFICATE OF CORRECTION

PATENT NO. : 3 952 139

DATED : April 20, 1976

INVENTOR(S) : Peter Bürkle et al

It is certified that error appears in the above-identified patent and that said Letters Patent are hereby corrected as shown below:

Column 4, line 17, change "35" to --25--.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*